US005806348A

United States Patent [19]

Cheng

[11] Patent Number: 5,806,348

[45] Date of Patent: Sep. 15, 1998

[54] HEALD ROD RETENTION DEVICE FOR A JACQUARD SYSTEM

[76] Inventor: Chuan-Tien Cheng, 2nd Fl., No. 25, Sec. 2, Ssuchuan Rd., Paochiao City, Taipei Hsien, Taiwan

[21] Appl. No.: 846,677

[22] Filed: Apr. 30, 1997

[51] Int. Cl.[6] ..... D03C 3/20; D04B 27/32

[52] U.S. Cl. ..... 66/218; 139/455

[58] Field of Search ..... 66/232, 219, 220, 66/218; 139/455

[56] References Cited

U.S. PATENT DOCUMENTS

| | | | |
|---|---|---|---|
| 4,969,490 | 11/1990 | Seiler | 139/455 |
| 5,095,952 | 3/1992 | Cheng | 139/455 |
| 5,309,953 | 5/1994 | Bassi et al. | 139/455 |
| 5,333,652 | 8/1994 | Bassi et al. | 139/455 |
| 5,392,820 | 2/1995 | Seiler | 139/455 |
| 5,462,097 | 10/1995 | Skalka | 66/218 |
| 5,666,999 | 9/1997 | Dewispelaere et al. | 66/218 |

*Primary Examiner*—Andy Falik

*Attorney, Agent, or Firm*—Hedman, Gibson & Costigan, P.C.

[57] ABSTRACT

A heald rod retention device for a jacquard system includes a mounting frame encasing a ferromagnet, a pair of retention plates pivotably mounted on the frame, each retention plate encasing coils and defining a lower hooked end, and two springs mounted on the frame. The springs respectively exert a laterally pushing force of the retention plates so that the lower hooked ends thereof are forced to move toward each other. A pair of heald rods are slideably mounted on the frame and respectively define upper hooked ends which are engaged with the lower hooked ends when the coils are energized and separated therefrom when the coils are not energized. Each heald rod further defines a protrusion for contact with a knife bar. A rope-pulley system is provided for connection with the heald rods and a jacquard needle.

7 Claims, 5 Drawing Sheets

HEALD ROD RETENTION DEVICE FOR A JACQUARD SYSTEM

FIELD OF THE INVENTION

The present invention is related to a heald rod retention device, particularly to a heald rod retention device, wherein the heald rods are connected with a jacquard needle via a pair of pulleys and a pair of ropes respectively extending around the pulleys and connected with the heald rod and the jacquard needle.

BACKGROUND OF THE INVENTION

A recently developed heald rod retention device for a jacquard system comprises a mounting frame, an electromagnet fixedly attached to the mounting frame, a pair of retention plates pivotably mounted on the mounting frame and which are made of steel and respectively have hooked ends, a pair of heald rods slideably mounted on the mounting frame, wherein each of the heald rods has a hooked end engageable with the hooked end of each of the retention plates, a pair of pulleys slideably mounted on the mounting frame, a first control rope section extending around a first pulley and having two ends respectively fixedly attached to the heald rods, a second control rope section extending around a second pulley and having a first end fixedly attached to the mounting frame and a second end for connection with a jacquard needle and a pair of helical springs respectively exerting a laterally pulling force on the heald rods so that in the normal condition that the electromagnet is not energized, the hooked ends of the retention plates are forced to move toward each other.

When the electromagnet is energized, it will attract an end of each of the retention plates remote from the hooked ends thereof to cause a pivot of the retention plates, and, thus, the hooked ends thereof will escape from their engagement with the hooked ends of the heald rods. In this condition, the heald rods are free to slide on the mounting frame downwardly or upwardly; thus, an upward and downward movement of a pair of knife bars respectively in contact with the heald rods will not cause a movement of the pulleys and the second control rope section. Accordingly, the jacquard needle in connection with the second control rope section will not move to perform a desired jacguard knitting.

Alternatively, when the electric energy input into the electromagnet is stopped, the attraction between the electromagnet and the retention plates is released and the helical springs will pull the retention plates to return to their respectively original positions, wherein the hooked ends of the heald rods are engaged with the hooked ends of the retention plates, whereby the downward movement of the heald rods is retained. Thus, a movement of the knife bars will cause a movement of the pulleys and the second control rope section. Accordingly, the jacquard needle in connection with the second control rope section will move to perform the desired jacquard knitting.

Although such a conventional heald rod retention device for a jacquard assembly is proven to be able to function well to control the movement of the jacquard needle to perform the jacquard knitting at a proper time, because of the design and structural limitations of the conventional heald rod retention device, each time when the knife bars have an upward movement to push the heald rods to move upwardly passing through the hooked ends of the retention plates, the hooked ends of the heald rods will collide with the hooked ends of the retention plates, which causes the hooked ends of the heald rods to become worn very quickly. According to experience, the heald rods should be replaced with new ones after eight to nine months of use. To replace the heald plates so frequently is expensive and is very laborious.

The present invention therefore is aimed at providing an improved heald rod retention device for a jacquard system to mitigate and/or obviate the aforementioned problems.

SUMMARY OF THE INVENTION

An objective of the present invention is to provide a heald rod retention device for a jacquard system, wherein the chance of collision between the hooked ends of the heald rods and the retention plates when the heald rods are moved upwardly by the knife bars can be largely reduced, so that useful life of the heald rods can be significantly extended.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
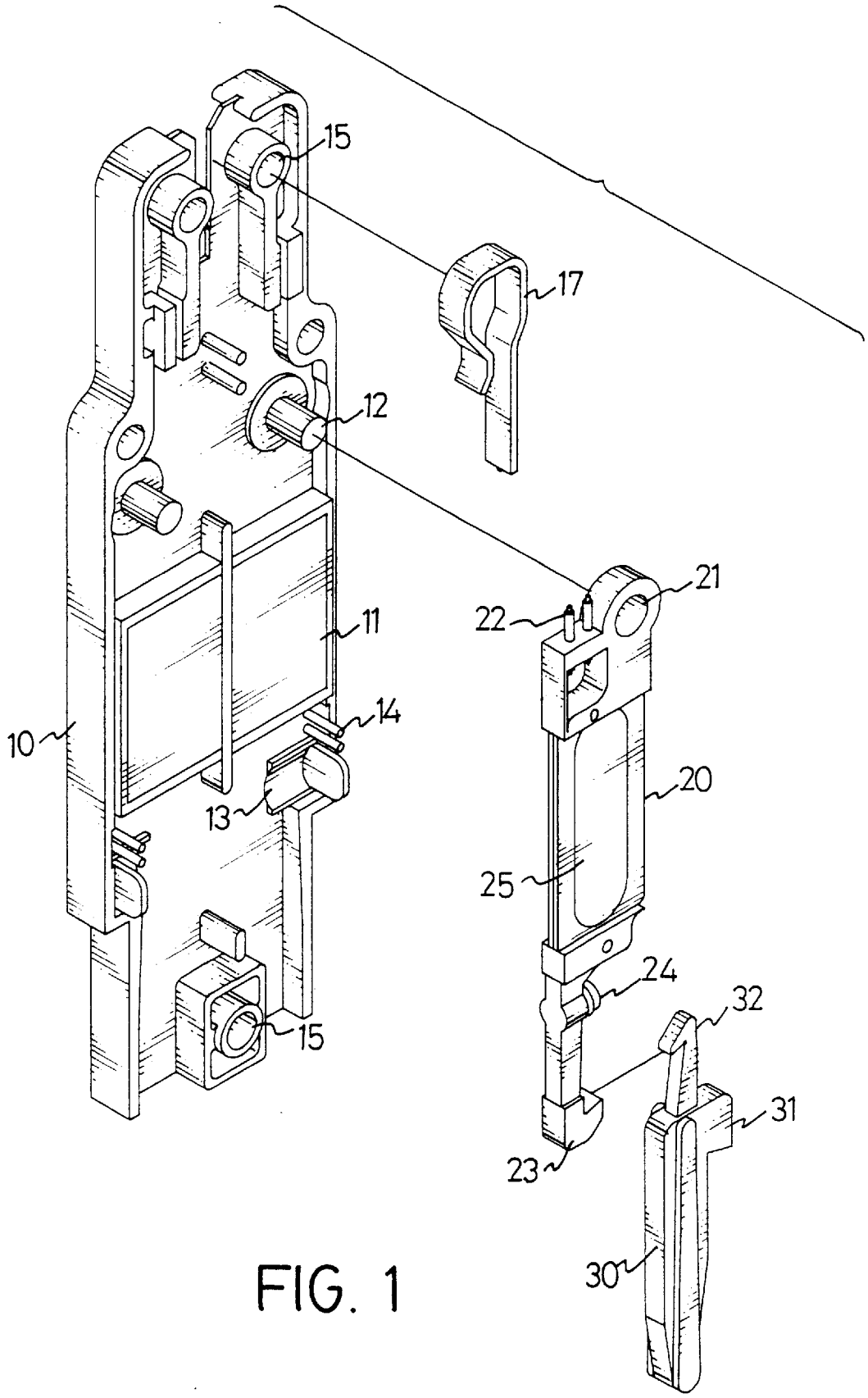
FIG. 1 is a left-front-top exploded view showing the elements constituting an upper portion of a heald rod retention device for a jacquard system in accordance with the present invention.

Referring to FIG. 1, elements for constituting an upper portion of a heald rod retention device in accordance with the present invention is shown. However, for clarity, a cover for covering a mounting frame 10 is not shown. Furthermore, only a single conductive plate 17, a single retention plate 20 and a single heald rod 30 are shown, although it can be understood by those skilled in the art that such elements respectively should have a quantity of two.

Figure 2:
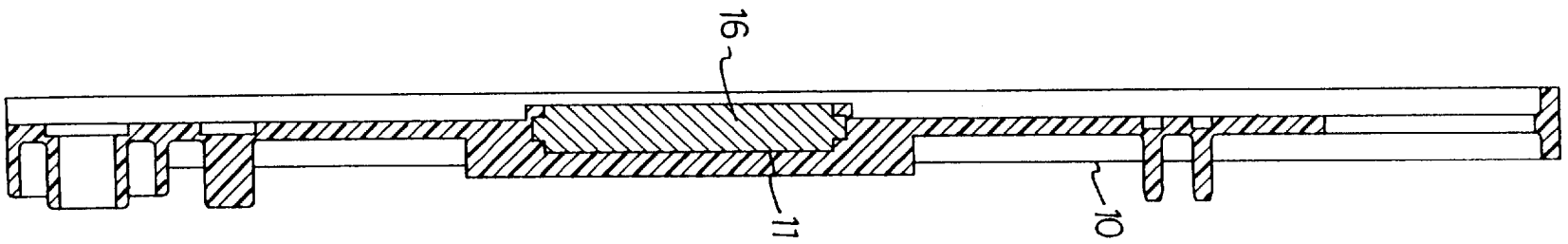
FIG. 2 is a left side, cross-sectional view showing the inner structure of a mounting frame.

The mounting frame 10 is made of plastics and formed with three mounting holes 15 by which the cover (not shown) can be assembled with the mounting frame 10 by screws (not shown). A ferromagnet-accommodating chamber 11 is defined in a center of the frame 10 for accommodating a ferromagnet 16 (better seen in FIG. 2). Two pivot pins 12 are provided above the ferromagnet-accommodating chamber 11. Two spring-accommodating recesses 13 are defined below the ferromagnet-accommodating chamber 11. Located above each of the spring-accommodating recesses 13, the frame 10 is formed with two cushioning member mounting pins 14. The conductive plate 17 is mounted on the frame at a position around the mounting hole 15 located at the right, upper corner of the mounting frame 10 (better seen in FIGS. 4 and 5).

Figure 3:
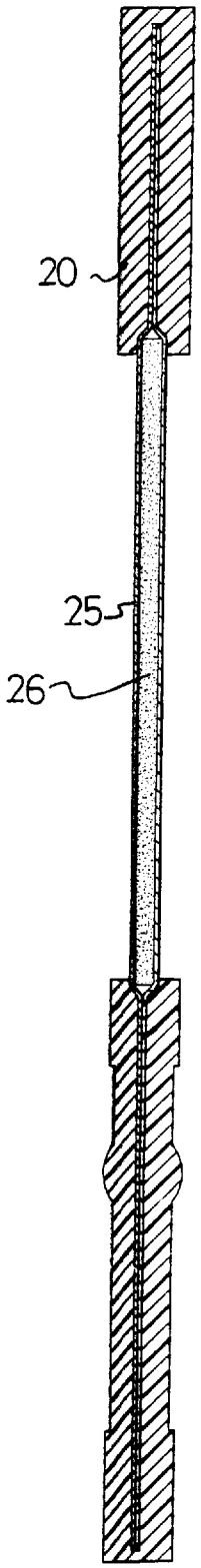
FIG. 3 is a left side, cross-sectional view showing the inner structure of a retention plate.

The retention plate 20 defines a pivot hole 21 for fittingly engaging with the pivot pin 12 so that the retention plate 20 can be pivotably mounted on the mounting frame 10. Two electrical connectors 22 are attached to a left, upper corner of the retention plate 20, whereby coils 26 (see FIG. 3) which are received in a coil-accommodating chamber constituted by two aluminum plates 25 can be connected to an electric power source (not shown) via the conductive plate 17 and electrical wires 222 between the conductive plate 17 and the electric connectors 22 (better seen in FIGS. 4 and 5). The coil-accommodating chamber is located about a center of the retention plate 20. The retention plate 20 is further formed with a side bulge 24 for engaging with a spring 27 received in the spring-accommodating recess 13 (better seen in FIGS. 4 and 5). The spring 27 is used to exert a laterally pushing force on the retention plate 20. Finally, the retention plate 20 is formed with a lower hooked end 23. Also referring to FIG. 3, the retention plate 20 is obtained by firstly putting the coils 26 between the aluminum plates 25. Then, the coils 26 and the aluminum plates 25 are brought together into a plastics injection mold to receive a plastics injection molding process. The method for forming the retention plate and the structure obtained therefrom indeed have never been taught by prior art.

The heald rod 30 is formed with a side protrusion 31 and an upper hooked end 32.

Figure 4:
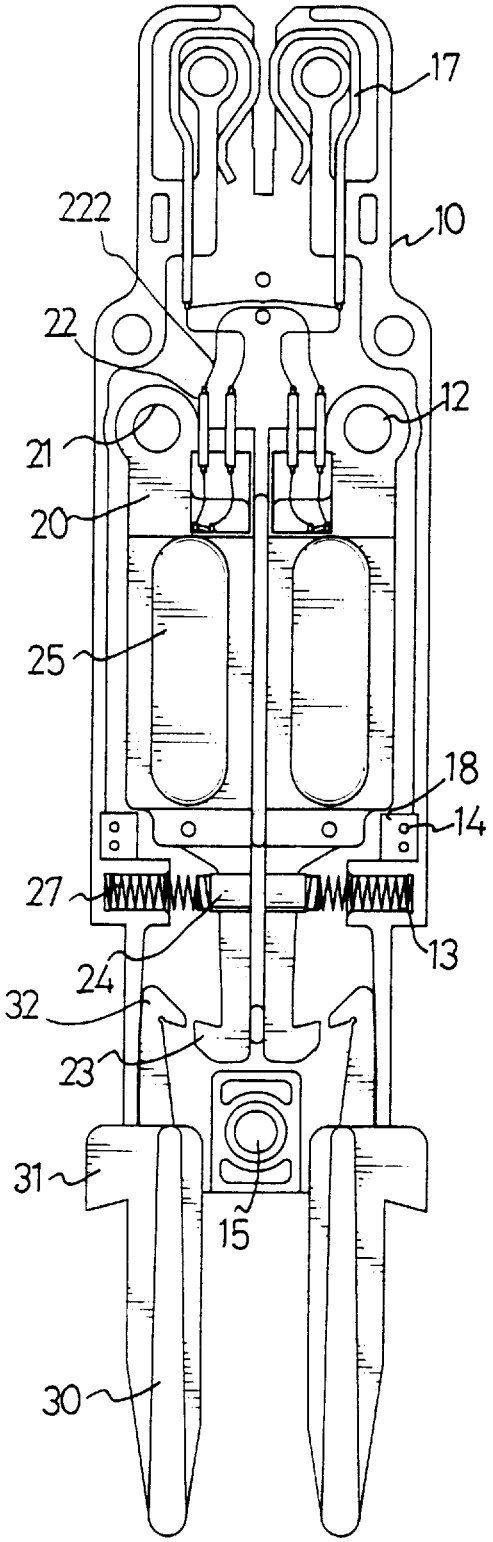
FIG. 4 is a front elevational view showing the upper portion of the heald rod retention device in an assembled state, wherein a pair of heald rods are in a released position.
Figure 5:
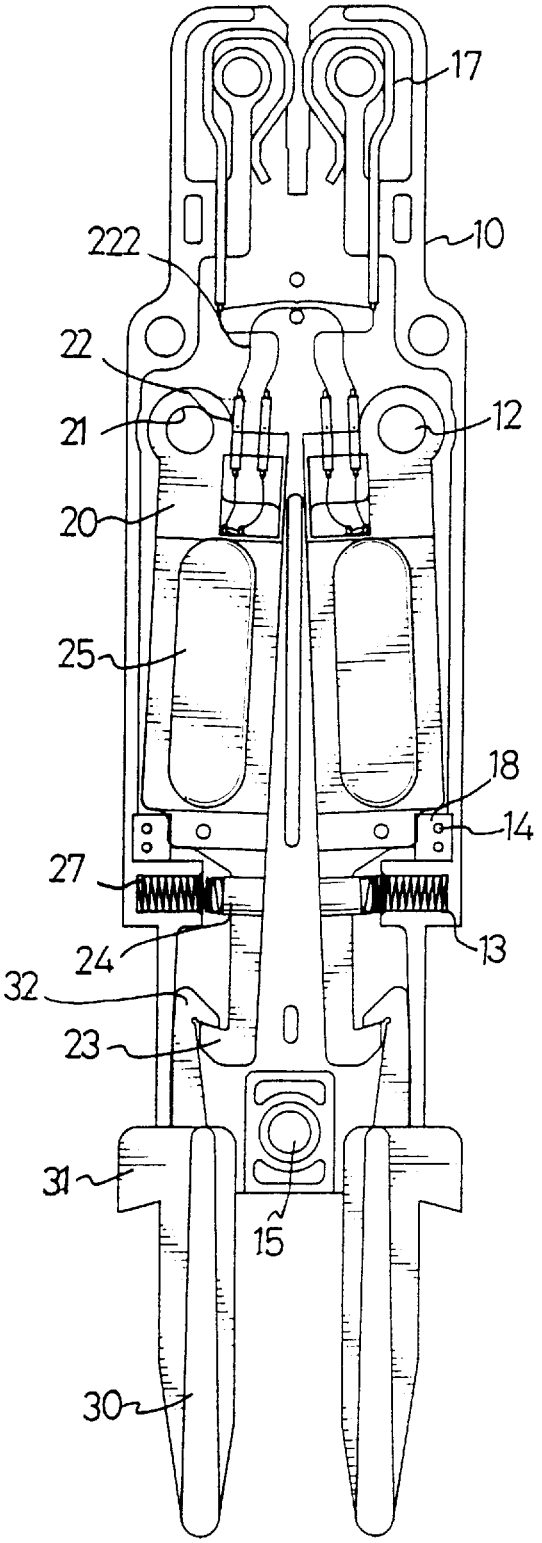
FIG. 5 is a view similar to FIG. 4 but showing that the heald rods are in a retained position.
Figure 6:
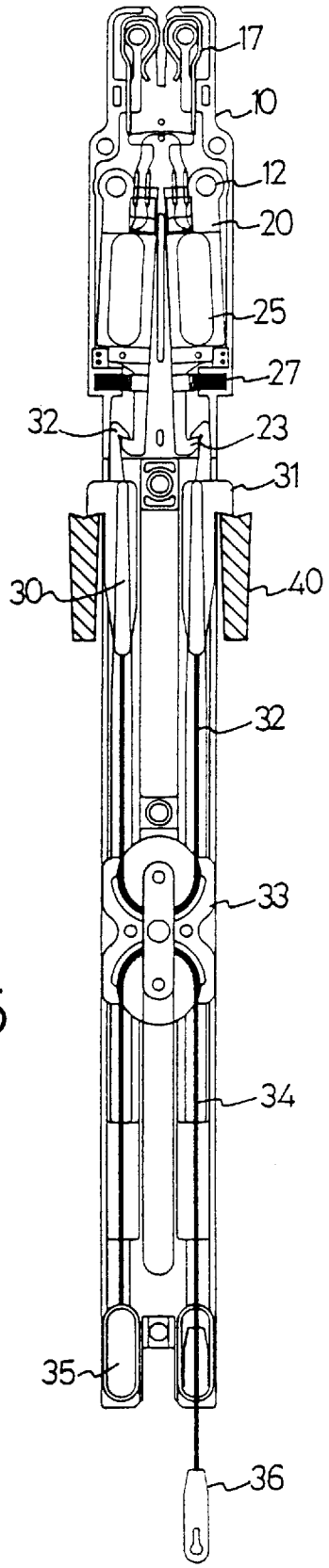
FIG. 6 is a front elevational view showing a whole heald rod retention device with two knife bars, wherein the heald rods are in the retained position.

Now refer to FIGS. 4 and 5, which show that the above-mentioned components for constituting the upper portion of the heald rod retention device in accordance with the present invention are assembled together, and the retention device is respectively at two positions. FIG. 4 shows that the retention device is at a normal position, in which the upper hooked ends 32 of the heald rods 30 are separated from the lower hooked ends 23 of the retention plates 20, so that the heald rods 30 are allowed to freely slide on the mounting frame 10 and a jacquard needle (not shown) in connection with the heald rods 30 via a rope-pulley system 32, 33, 34 as shown by FIG. 6 will not perform a required jacquard knitting. At the position as shown by FIG. 4, the coils 26 are not energized so that there is not interaction between the coils 26 and the ferromagnet 16, and the lower hooked ends 23 of the retention plates 20 are forced to move toward each other by the action of the springs 27.

Alternatively, FIG. 5 shows that the detention device is at an operating position, in which the retention plates 20 are pivoted and the lower hooked ends thereof 23 are respectively engaged with the upper hooked ends 32 so that the jacquard needle (not shown) will perform the required jacquard knitting. At the position as shown by FIG. 5, the coils 26 are energized so that there is an interaction (i.e., repulsion) between the coils 26 and the ferromagnet 16, and the lower hooked ends 23 are forced to move toward the lateral sides of the mounting frame 10, in which the springs 27 are compressed and a corner of each of the retention plates 20 located outside and below the coils 26 is rested against a cushioning member 18 mounted on the cushioning member mounting pins 14. The cushioning members 18 are used to absorb the force caused by the retention plates 20 when the coils 26 are energized to cause the retention plates 20 to pivot about the mounting frame 10.

From FIGS. 4 and 5, it can be understood that the advantage of the present invention over prior art is in that at the normal position (which means that the coils 26 are not energized), due to the pushing action of the springs 27, the lower hooked ends 23 are at a location spaced from the sliding path of the heald rods 3, so that when the heald rods 30 slide on the mounting plate 10, the upper hooked ends 32 thereof will not collide with the lower hooked ends 23 of the retention plate 20; thus, the frequency that the upper ends 32 will collide with the lower ends 23 can be largely lowered and the usable life of the heald rods 30 can be significantly extended.

FIG. 6 shows that the upper portion of the heald rod retention device in accordance with the present invention is combined with the rope-pulley system to complete the heald rod retention device in accordance with the present invention, wherein the rope-pulley system has a structure like that of prior art and consists of a first control rope section 32 having two ends respectively connected with the heald rods 30 and extending around an upper one of a pair of pulleys 33, wherein the pair of pulleys are slideably mounted on the mounting frame 10, a second control rope section 34 having a first end 35 fixedly anchored to a lower extension of the mounting frame 10 and a second end 36 for connection with the jacquard needle (not shown) and extending around a lower one of the pair of pulleys 33.

Also as shown in FIG. 6, two knife bars 40 are respectively contacted with the side protrusions 31 of the heald rods 31. Since in FIG. 6, the lower hooked ends 23 are engaged with the upper hooked ends 32, when heald rods 30 are driven by the knife bars 40 to have an upward movement, the pulleys 33 will move up accordingly to cause the jacquard needle (not shown) in connection with the second end 36 of second control rope section 34 to also have an upward movement to perform the jacquard knitting.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A heald rod retention device for a jacquard system, comprising:

a mounting frame, said mounting frame comprising a ferromagnet;

a pair of retention plates pivotably mounted on the mounting plate, each retention plate comprising coils and a first hooked end, wherein when the coils are energized, they will have an interaction with the ferromagnet to cause the retention plates to pivot about the mounting frame in a first direction so that the first hooked ends are moved away from each other;

a pair of springs respectively exerting a force on the retention plates to cause the first hooked ends thereof to move toward each other;

a pair of heald rods slideably mounted on the mounting frame, each heald rod defining a second hooked end which is engaged with a respective one of the first hooked ends when the coils are energized and separated therefrom when the coils are not energized;

a pair of pulleys slideably mounting on the mounting frame;

a first control rope section having two ends respectively connected with the heald rods and extending around a first one of the pair of pulleys; and a second control rope section having a first end fixedly anchored to the mounting frame and a second end adapted for connection with a jacquard needle and extending around a second one of the pair of pulleys.

2. The heald rod retention device in accordance with claim 1, wherein the mounting frame is formed with a chamber for receiving the ferromagnet.

3. The heald rod retention device in accordance with claim 1, wherein the mounting frame is formed with two pivot pins and each of the retention plates is formed with a hole fittingly engaged with a respective one of the pivot pins so that the retention plates are pivotably mounted on the mounting frame.

4. The heald rod retention device in accordance with claim 1, wherein each of the retention plates is formed with a side bulge and the mounting frame is formed with a pair of spring-accommodating recesses accommodating the pair of springs, and wherein the springs are engaged respectively with the side bulges and exert a pushing force on the retention plates.

5. The heald rod retention device in accordance with claim 1, wherein the mounting frame is formed with cushioning member mounting pins on two sides thereof, and the heald rod retention device further comprises two cushioning members respectively mounted on the cushioning member mounting pins, said cushioning members being used to absorb the force caused by the retention plates when the coils are energized to cause the retention plates to pivot about the mounting frame in the first direction.

6. The heald rod retention device in accordance with claim 1, wherein each of the retention plates is formed with a coil-accommodating chamber located about a center thereof, said coil-accommodating chamber receiving said coils.

7. The heald rod retention device in accordance with claim 6, wherein the coil-accommodating chamber comprises two aluminum plates.

* * * * *